US005526973A

United States Patent [19]

Boone et al.

[11] Patent Number: 5,526,973

[45] Date of Patent: Jun. 18, 1996

[54] AUTOMATIC WEB TRANSFER MECHANISM FOR FLEXIBLE SHEET DISPENSER

[75] Inventors: Bruce T. Boone, Acworth; John S. Formon, Marietta, both of Ga.

[73] Assignee: Georgia-Pacific Corporation, Atlanta, Ga.

[21] Appl. No.: 319,624

[22] Filed: Oct. 7, 1994

Related U.S. Application Data

[62] Division of Ser. No. 984,459, Dec. 2, 1992, Pat. No. 5,375,785.

[51] Int. Cl.[6] ..... B26F 3/02; B65H 19/10

[52] U.S. Cl. ..... 225/34; 225/39; 225/77; 225/81; 242/560.1; 242/564.4; 242/566

[58] Field of Search ..... 225/34, 39, 77, 225/81, 91; 242/560.1, 562, 562.1, 563, 563.1, 564.4, 566, 584

[56] References Cited

U.S. PATENT DOCUMENTS

| | | | |
|---|---|---|---|
| Re. 28,911 | 7/1976 | Jespersen et al. | 225/96 |
| 2,001,113 | 5/1935 | Schaefer, Jr. | 242/560.3 |
| 2,738,934 | 3/1956 | Dobkin | 242/560.1 |
| 2,785,034 | 3/1957 | Preston | 312/34.15 |
| 2,839,345 | 6/1958 | Engel et al. | 225/16 |
| 2,896,944 | 7/1959 | Shiba | 226/11 |
| 2,919,842 | 1/1960 | Batlas | 225/12 |
| 2,930,663 | 3/1960 | Weiss | 242/560.1 |
| 2,930,664 | 3/1960 | Liebisch | 242/560 |
| 2,974,839 | 3/1961 | Batlas et al. | 225/12 |
| 3,007,650 | 11/1961 | Burton | 242/560.1 |
| 3,038,598 | 6/1962 | Layton et al. | 242/1 |
| 3,065,782 | 11/1962 | Vergobbi | 156/504 |
| 3,072,354 | 1/1963 | Giles et al. | 242/554.4 |
| 3,126,234 | 3/1964 | Batlas et al. | 242/560 |
| 3,217,953 | 11/1965 | Bahnsen | 225/16 |
| 3,269,592 | 8/1966 | Slye et al. | 221/44 |
| 3,288,387 | 11/1966 | Craven, Jr. | 242/560.1 |
| 3,306,801 | 2/1967 | Giles | 156/353 |
| 3,606,306 | 9/1971 | Brown, Jr. et al. | 271/31 |
| 3,628,743 | 12/1971 | Bastian et al. | 242/560.1 |
| 3,650,487 | 3/1972 | Bahnsen | 242/560.3 |
| 3,653,733 | 4/1972 | Wyant | 242/564.4 |
| 3,700,181 | 10/1972 | Diring et al. | 242/560.3 |
| 3,771,739 | 11/1973 | Nelson | 242/560.3 |
| 3,843,253 | 10/1974 | Mikan et al. | 355/29 |
| 3,858,951 | 1/1975 | Rasmussen | 312/34.12 |
| 3,907,235 | 9/1975 | Gaubert | 242/554 |
| 3,915,399 | 10/1975 | Kron et al. | 242/555.6 |
| 3,917,191 | 11/1975 | Graham, Jr. et al. | 242/560.1 |
| 3,948,715 | 4/1976 | Tokuno | 156/351 |
| 4,010,909 | 3/1977 | Bastian | 242/560.1 |
| 4,106,684 | 8/1978 | Hartbauer et al. | 226/91 |
| 4,116,399 | 9/1978 | Mosburger et al. | 242/552 |
| 4,137,805 | 2/1979 | DeLuca et al. | 83/345 |
| 4,148,442 | 4/1979 | Baumann et al. | 242/560.1 |
| 4,165,138 | 8/1979 | Hedge et al. | 242/560 |
| 4,358,169 | 11/1982 | Filipowicz et al. | 225/34 X |
| 4,378,912 | 4/1983 | Perrin et al. | 242/560.1 |
| 4,807,824 | 2/1989 | Gains et al. | 242/560.1 |

FOREIGN PATENT DOCUMENTS

| | | |
|---|---|---|
| 1033693 | 6/1978 | Canada . |
| 1554610 | 1/1970 | Germany . |
| 31-2252 | 2/1956 | Japan . |
| 47-20019 | 7/1972 | Japan . |
| 1424145 | 2/1976 | United Kingdom . |

*Primary Examiner*—Rinaldi I. Rada
*Assistant Examiner*—Raymond D. Woods
*Attorney, Agent, or Firm*—Banner & Allegretti, Ltd.

[57] ABSTRACT

A dispenser for sequentially dispensing web material from a primary web roll and then a reserve web roll. The dispenser senses the presence of the primary web directly at the feed nip defined by two feed rollers and introduces the leading edge of the reserve web roll to the feed nip immediately after the trailing end of the primary web roll passes through the feed nip. The movement of one feed roller relative to the other feed roller actuates the transfer mechanism which introduces the reserve web to the feed nip.

7 Claims, 7 Drawing Sheets

AUTOMATIC WEB TRANSFER MECHANISM FOR FLEXIBLE SHEET DISPENSER

This application is a division, of application Ser. No. 07/984459, filed Dec. 2, 1992, now U.S. Pat. No. 5,375,785.

TECHNICAL FIELD

The present invention relates to a flexible sheet dispenser for sequentially dispensing a web of material from a plurality of rolls, and in particular, to an automatic transfer mechanism for transferring the feed supply from the primary roll to a reserve roll upon the exhaustion of the primary roll.

BACKGROUND OF THE INVENTION

Industrial dispensers for toweling are primarily designed to dispense either a continuous length of web material, folded paper towels, or rolls of paper towels. Continuous towels are generally made of a reusable material and form a towel loop outside of the dispenser cabinet for the consumer to use. Folded towels are paper towels which are pre-cut and folded into various configurations to be individually dispensed for use. Roll towels are continuous rolls of paper toweling which are wound around a cardboard core and which are, upon dispensing, separated into and delivered as individual lengths of material.

Continuous web dispensers, such as those disclosed in U.S. Pat. No. 2,930,663 to Weiss and U.S. Pat. No. 3,858,951 to Rasmussen, require the user to pull on the loop of exposed toweling in order to cause a length of clean toweling to be dispensed and the exposed soiled toweling to be correspondingly taken up within the dispenser. Although economical, the continuous exposure of the soiled toweling is deemed unsightly, and therefore unacceptable to many consumers when compared to the many available alternatives. Further, the exposure and possible reuse of soiled toweling may present additional health hazards and sanitation concerns which should be avoided.

The use of either interfolded paper towels or C-fold paper towels eliminates the potential health risks associated with continuous web toweling. Dispensers for folded paper towels allow a user to pull the exposed end of a new individual towel in order to dispense the towel. These dispensers, such as the one disclosed in U.S. Pat. No. 3,269,592 to Slye et at., are also easy to refill with folded towels. That is, when the dispenser is partially empty, the cover can simply be removed and the remaining stack of towels can be replenished through the open top. Folded towels are, however, not usually the most economical alternative for institutional or other high-volume situations.

Roll towels are cheaper to manufacture than folded towels and also eliminate the potential health and sanitation problems associated with continuous web toweling systems. Dispensers for roll towels usually include a lever, crank, or other user-activated mechanism for dispensing a length of towel and a blade for then severing the length of towel from the remaining roll. In contrast to folded towels, however, there is no way to simply replenish a partially depleted roll of web material in a roll dispenser. In some prior art dispensers, a new roll must be substituted thereby resulting in the waste of the partially depleted roll, or "stub" roll. To overcome the problem of stub roll waste, roll dispensers have been designed to dispense two rolls of web material sequentially such that upon depletion of a primary roll, feeding from a reserve roll is commenced. Prior art systems have accomplished this transfer by either modifying the end of the web material or modifying the roll core upon which the web material is wound, such as the system disclosed in U.S. Pat. No. 3,288,387 to Craven, Jr. Alternatively, the system of U.S. Pat. No. 3,628,743 to Bastian et al. senses the diameter of the primary roll in order to activate the transfer to the reserve roll and the system of U.S. Pat. No. 3,917,191 to Graham, Jr. et al. senses the tension in the primary roll in order to detect when it is nearly exhausted. Unfortunately, tension responsive transfers are not particularly reliable since conditions other than reaching the end of roll can trigger their operation, such as the slackening of the web or a break in the web material. Diameter responsive transfers also have their drawback in that the reserve web begins dispensing prior to the complete exhaustion of the primary roll. Thus, for a short time web material is dispensed simultaneously from both rolls and again results in a waste of material.

To overcome these disadvantages, the systems of U.S. Pat. No. 4,165,138 to Hedge et at. and U.S. Pat. No. 4,378,912 to Perrin et al. provide a transfer mechanism which is based on the feed rolls themselves. These systems utilize a transfer mechanism which senses the absence or presence of paper from around a grooved feed roll by using a sensing finger which rides along the top surface of the web material and which then drops down into the groove in the feed roll when the trailing end of the primary web has passed thereover and thus uncovers the groove. Responsive to the movement of the sensing finger into the groove, the reserve web is introduced into the feed nip between the feed rolls and dispensing from the reserve roll begins. This type of transfer mechanism generally eliminates the false transfer associated with tension responsive systems and reduces the amount of double sheet dispensing which occurs in other prior art diameter and end of roll responsive systems. The use of sensing fingers on the web material, however, produces extra friction which can inadvertently tear the web and the introduction of additional components to sense the absence of the web and transfer the reserve web to between the feed rollers creates even more opportunities for a transfer failure to occur.

A strong need therefore has existed for a flexible sheet dispenser having an automatic transfer mechanism which substantially eliminates the simultaneous dispensing from both primary and reserve rolls, which requires few additional parts within the dispenser and which does not obstruct the proper dispensing of either the primary or reserve web material.

SUMMARY OF THE INVENTION

The present invention is directed to overcoming the disadvantages of the prior art by providing a flexible sheet material dispenser having a chassis with a rear wall, a front cover and a slot through which the flexible sheet material is dispensed. A primary roll of flexible sheet material and a reserve roll of flexible sheet material are supported within the chassis. Further, feed and sensing means define a feed nip for dispensing a web of sheet material from either the primary roll or the reserve roll and for sensing the presence of the primary web in the feed nip. Transferring means are also provided to transfer the leading edge of the reserve web to the feed nip in response to the feed and sensing means sensing the absence of the primary web at the feed nip.

In a preferred embodiment of the present invention, the feed and sensing means includes first and second rotatable rollers which define the feed nip and which have a plurality of mutually intermeshing grooves formed therein. The primary web of material passing through the feed nip prevents the grooves on the first and second rollers from intermeshing. When a trailing edge of the primary material web passes through the feed nip, however, the grooves are thereby uncovered and thus allow the intermeshing of the first and second feed rollers which actuates the transfer means. The transfer means of the present invention includes a transfer bar which rotates towards the feed roller and introduces the leading edge of the reserve web to the feed nip in response to the intermeshing of the feed rollers.

BRIEF DESCRIPTION OF THE DRAWINGS

The novel features of the present invention are set out with particularity in the appended claims, but the invention will be understood more fully and clearly from the following detailed description of the invention as set forth in the accompanying drawings, in which:

DETAILED DESCRIPTION OF PREFERRED EMBODIMENTS

Figure 1:
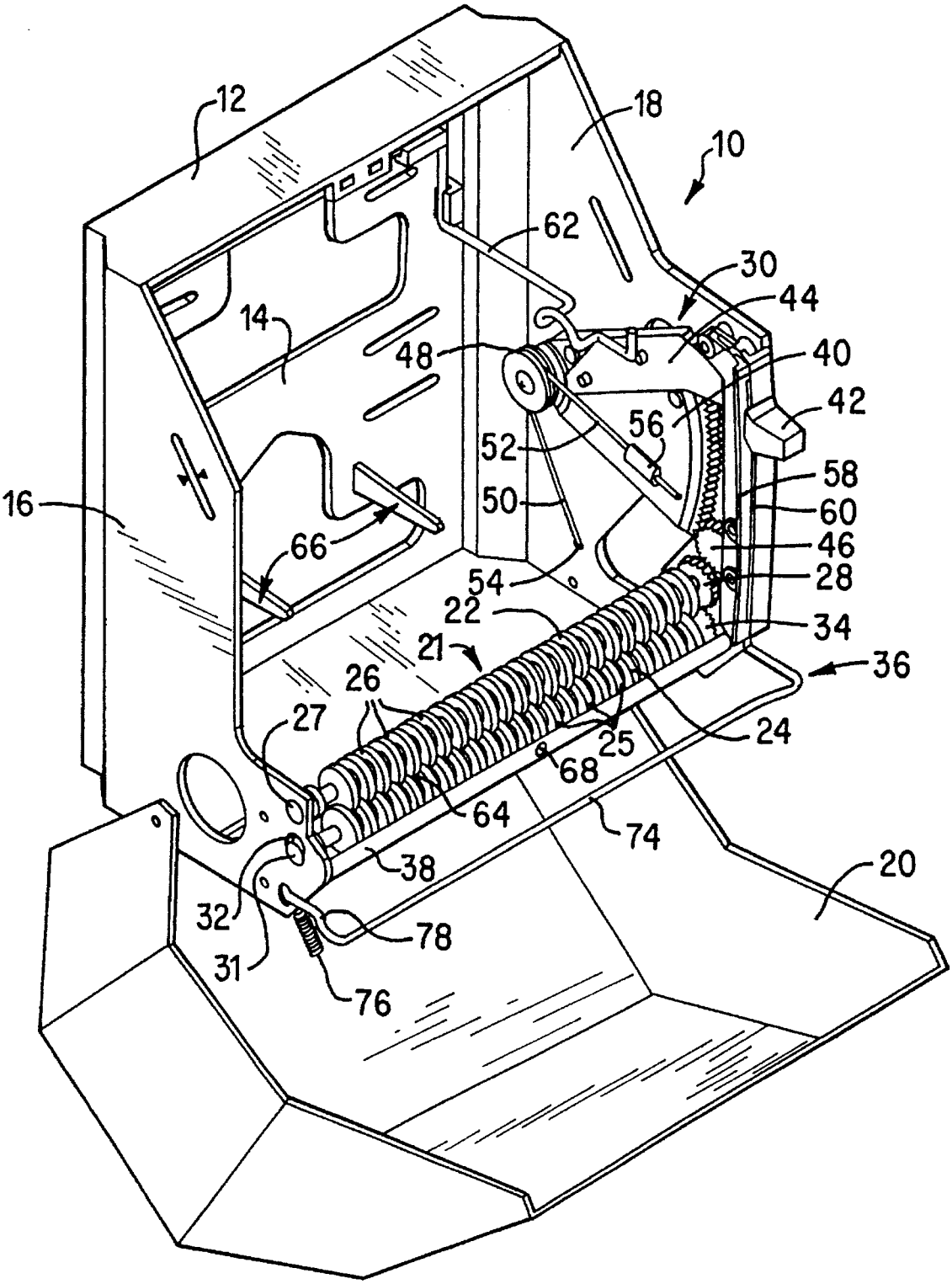
FIG. 1 is a perspective view of the dispenser of the present invention with the cover in an open position.
Figure 3:
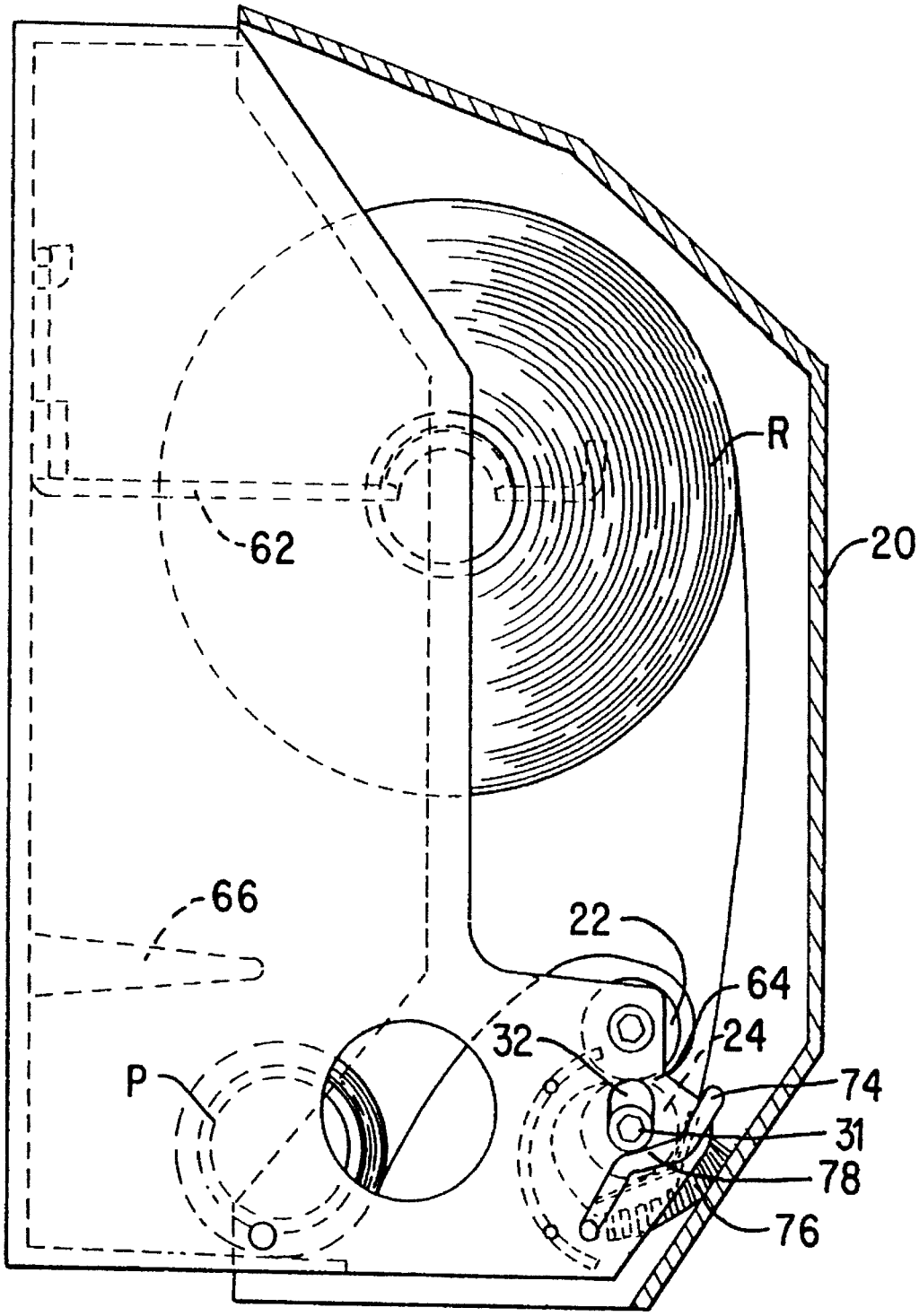
FIG. 3 is a side elevational view of the dispenser shown in FIG. 1 illustrating web material being dispensed from the primary roll when the cover, shown in cross-section, is in a closed position.
Figure 4:
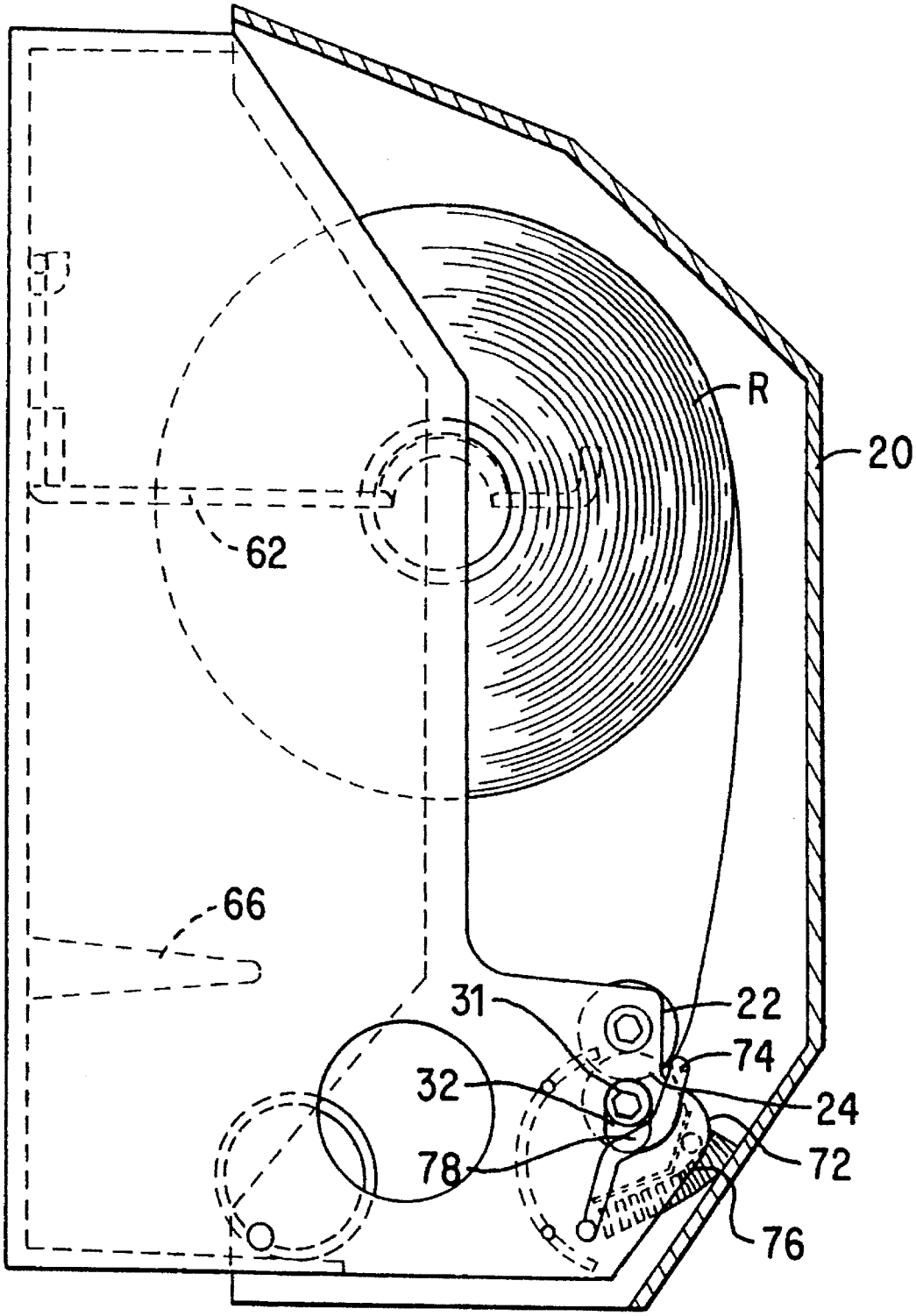
FIG. 4 is a side elevational view of the dispenser shown in FIG. 1 illustrating web material beginning to dispense from the reserve roll.

A dispenser according to the present invention is illustrated in FIG. 1 and designated generally by the numeral 10. Dispenser 10 comprises a chassis 12 including a back panel 14, side panels 16 and 18, and a front cover 20 which is pivotally attached to chassis 12 by a pin, hinge, or other conventional attachment means. A blade 38 also extends across the front edge of chassis 12 to assist in the tearing of a single sheet of web material as it exists through a bottom opening 37 in chassis 12. The feed mechanism 21 of the present invention comprises two feed rollers 22 and 24 having regularly spaced grooves 26 between annular ribs 25 such that rollers 22 and 24 are capable of meshing with one another. Feed rollers 22 and 24 are disposed between side panels 16 and 18 towards the front of chassis 12 and are held in place by various bushings and/or gears. In particular, feed roller 22 is connected by a bushing 27 to side panel 16 and to side panel 18 by drive gear 28 disposed on the end thereof. Feed roller 22 is rotated in place by drive gear 28 when dispensing mechanism 30 is actuated, as described in greater detail below. End 31 of feed roller 24 is disposed within a slot 32 formed in side panel 16, while the other end of feed roller 24 is connected to side panel 18 through a drive gear 34 which is drivingly engaged with drive gear 28. Thus, in a preferred embodiment of the present invention feed roller 24 is rotated along with feed roller 22 upon the actuation of dispensing mechanism 30. An alternative embodiment of the invention utilizes only one feed roller which is driven and the other feed roller acts merely as a pressure roller upon the driven feed roller. It is preferred however to have both feed rollers driven in order to produce a sufficient force to introduce the reserve web material into the feed nip, as described below. In addition, end 31 of feed roller 24 is pivotable within slot 32 such that feed roller 24 can travel towards or away from feed roller 22. This pivoting motion provides feed roller 24 with the ability to determine whether or not there is web material present between the feed rollers. That is, movement of feed roller 24 towards feed roller 22 is caused by a lack of web material between the rollers and in turn actuates transfer mechanism 36 of the present invention in order to begin dispensing from a reserve roll, as shown in FIGS. 2–4 and described below.

As shown in FIG. 1, dispensing mechanism 30 comprises a lever sector 40, a handle 42, and a steel lever 44 physically connected therebetween such that user actuation of handle 42 results in a corresponding movement of lever sector 40. Thus, movement of handle 42 downwards from an initial dispensing position shown in FIG. 1 causes lever sector 40 to pivot downwards, thereby rotating float gear 46 through the intermeshing movement of gear teeth and also rotating drive gears 28 and 34 which are disposed in driving relationship with float gear 46. Lever spring 48 then urges the return upwards movement of lever sector 40 and handle 42 to the initial dispensing position. Lever spring 48 includes a first leg 50 which is anchored to chassis 12 and a second leg 52 which is securely connected to lever sector 40. In a preferred embodiment, first leg 50 has an L-shaped terminal end (not shown) which extends through a hole 54 provided in chassis 12 and thereby firmly anchors spring 48. Second leg 52 extends through a cylindrical housing 56 attached to the inner side of lever sector 40. In order to prevent the reverse rotation of feed rollers 22 and 24 as lever sector 40 returns to the initial dispensing position, float gear 46 follows lever sector 40 and moves upwards in a slot (not shown) provided in side panel 18 such that the float gear is out of driving engagement with drive gear 28 on the return stroke to the initial dispensing position. Handle 42 and lever 44 move up and down in the path defined between parallel lever guides 58 and 60. Dispensing mechanism 30 of the present invention thus provides an efficient user-actuated method for dispensing a predetermined length of roll toweling. Unlike the continuous towel dispensers of the prior art, the present invention does not require the user to handle soiled toweling in order to dispense clean toweling. Further, by using float gear 46 to prevent the reverse rotation of feed rollers 22 and 24 and the reverse feeding of the web material, dispensing mechanism 30 also reduces the likelihood of jamming, and thus the frequent need for a service attendant.

Figure 2:
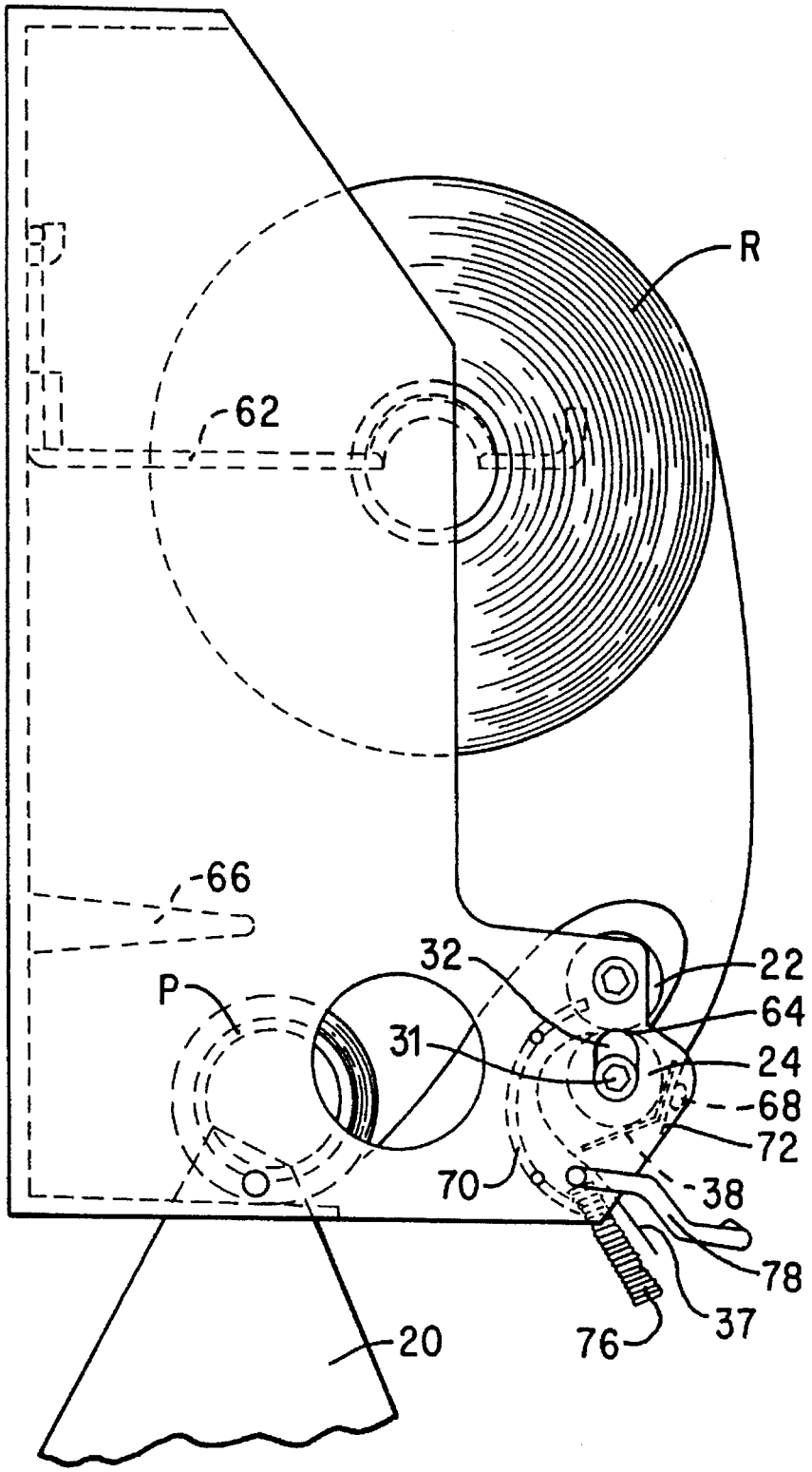
FIG. 2 is a side elevational view of the dispenser shown in FIG. 1 with the cover also in an open position.

Referring also to FIG. 2, dispenser 10 is shown in the loading position. That is, the stub roll or primary roll P which was being dispensed through a feed nip 64 defined by feed rollers 22 and 24 has been relocated by an attendant manually opening front cover 20, removing the wireform 62 from the core of roll P, and then repositioning roll P in the rear of chassis 12. Projections 66 extending from back panel 14 form a rear compartment for containing primary roll P and for preventing too large of a primary roll P from being placed in the rear compartment. A new reserve roll R has been disposed by the attendant on yoke wireform 62 by inserting the ends of the yoke into the core of roll R and the leading edge 72 is held by a tab 68 projecting from blade 38. In a preferred embodiment of the invention, tab 68 pierces leading edge 72 of reserve roll R and thereby holds it out of engagement with feed nip 64 until the primary roll P is exhausted and it is time to feed the reserve web to the feed nip. A deflector 70 is also provided to guide the web of material as it exits feed nip 64, passes below blade 38 and then through bottom opening 37. In addition, deflector 70 prevents primary roll P from moving forwards and interfering with feed mechanism 21.

Figure 5:
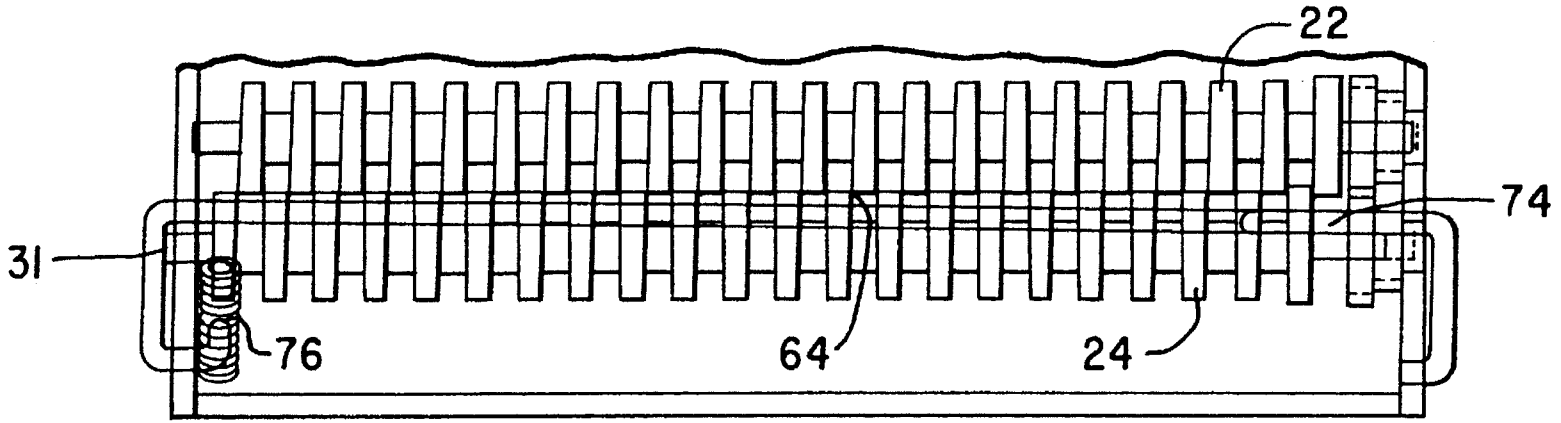
FIG. 5 is a partial front elevational view of the feed rollers of FIG. 3 illustrated in isolation in non-intermeshed relation.

After the stub of primary roll P has been repositioned beneath projections 66 and reserve roll R has been manually loaded onto wireform 62 with leading edge 72 held by tab 68, cover 20 is closed and dispenser 10 is ready for operation. Referring to FIGS. 1, 3 and 5, transfer mechanism 36 comprises a transfer bar 74 having two side arms and a front extension which extends the entire width of chassis 12 and a coil spring 76 which is connected in pivital relation to transfer bar 74. As shown in FIG. 3, when front cover 20 is closed coil spring 76 biases transfer bar 74 inward towards feed nip 64. Coil Spring 76 is preferably a torsion spring, however, a compression spring or tension spring could also be used. To prevent transfer bar 74 from prematurely contacting reserve web R, however, the transfer bar includes an angled side portion 78 which is disposed against end 31 of roller 24 which extends through slot 32. Transfer bar 72 is thus held against further inward rotation by the contact of angled side portion 78 against end 31. With primary web P passing through feed nip 64, extending end 31 is disposed in the lowermost portion of slot 32 and the annular fibs and grooves of feed rollers 22 and 24 are held out of intermeshing engagement and in a generally parallel position. In turn, side portion 78 is biased against end 31 by coil spring 76 and transfer bar 74 is prevented from dislodging reserve web R from tab 68 and from moving towards feed nip 64. By using feed rollers 22 and 24 as detectors to sense the presence of web material at feed nip 64, the present invention eliminates the need for a separate sensing mechanism as in the prior art devices. Accordingly, with fewer components there is less chance of failure occurring, greater economy and lower weight. In addition, because there is no sensing member riding on the surface of the web material and creating additional friction, there is also less chance of accidentally breaking the web of material.

Figure 6:
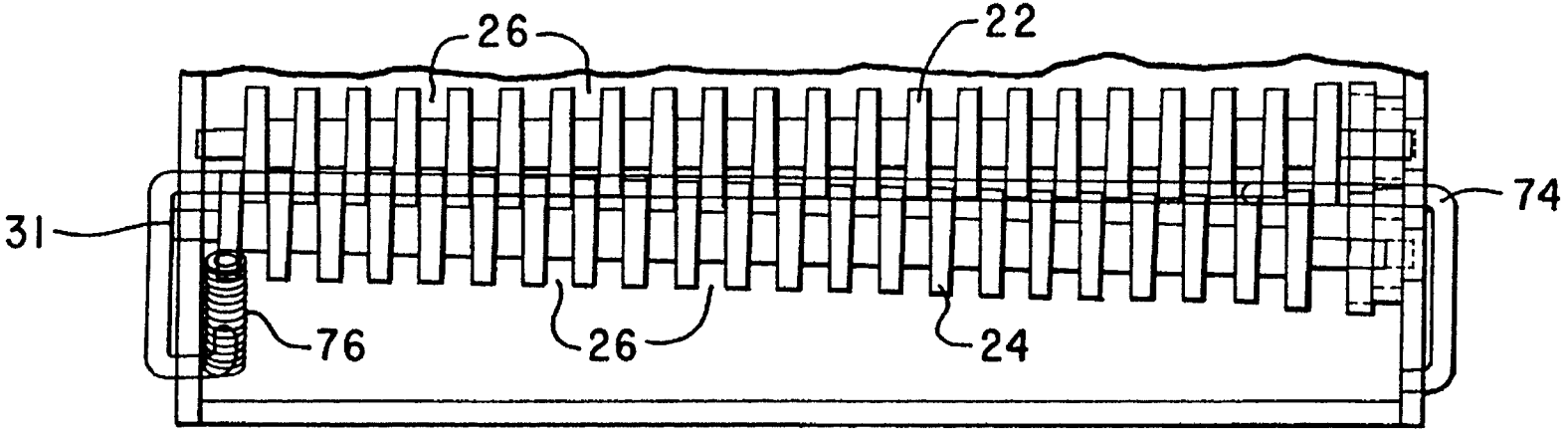
FIG. 6 is a partial front elevational view of the feed rollers of FIG. 4 illustrated in isolation in intermeshed relation.

Referring to FIGS. 1, 4 and 6, when primary web P is exhausted and the trailing end thereof exits feed nip 64, the absence of web material allows feed roller 24 to move towards feed roller 22 and the rollers obtain an intermeshing position which actuates transfer mechanism 36. As feed roller 24 moves towards feed roller 22, extending end 31 of roller 24 moves to the uppermost position in slot 32. Angled side portion 78 of transfer bar 74 follows extending end 31 upwards and, in turn, the transfer bar pivots towards feed nip 64 due to the biasing force of coil spring 76 against front cover 20. As transfer bar 74 moves towards feed nip 64 it contacts the reserve web and simultaneously moves leading edge 72 of reserve web R as it pivots. Thus, as transfer bar 74 reaches a position adjacent feed nip 64, leading edge 72 of reserve web R is also tucked into a position immediately adjacent feed nip 64, and ready to be introduced through the feed nip. Upon the next actuation of handle 42, the driving rotation of feed rollers 22 and 24 will pull reserve web R off of tab 68 and through feed nip 64 such that dispensing from the reserve roll thereby commences. Since transfer mechanism 36 is actuated responsive to a lack of web of material at the feed nip 64, instead of around or adjacent the feed roller, the problem encountered in the prior art of dispensing a double thickness of web material is avoided and therefore not wasted. There is no overlap between the trailing end of primary web P and reverse web R. The reliability of transfer mechanism 36 is also an improvement over the prior art since it is not tension responsive and is therefore not falsely triggered by a tension loss in the web material.

Once introduced to feed nip 64, reserve web R passes through feed nip 64 and separates feed rollers 22 and 24 to prevent the intermeshing of the grooved rollers. Extending end 31 of feed roller 24 also returns to the lowermost position in slot 32 and transfer bar 74 is likewise moved away from feed nip 64 by the pressure of end 31 on angled side portion 78. The rollers 22, 24 are thus in the dispensing position shown in FIG. 3 and dispensing of the web material from reserve roll R will continue until a point in time when reserve roll R is nearly exhausted. When reserve roll R reaches this stage, dispenser 10 is opened and reloaded as described previously with respect to FIG. 2. It should be noted that reloading of dispenser 10 is simplified by having the stub roll disposed in the bottom of chassis 12. That is, when cover 20 is opened and dropped downwards, the core of primary roll P is already waiting to be removed from the chassis in the bottom thereof. Since the bottom of cover 20 is beneath where the bottom of chassis 12 terminates, when primary roll P is exhausted the core of the roll falls naturally into cover 20 when it is opened. Reserve roll R is manually removed from yoke wireform 62 by an attendant and now becomes the stub roll disposed in the lowermost portion of chassis 12 beneath projections 66. A new reserve roll is inserted on wireform 62, the leading edge of the new roll is fastened to tab 68, and the dispenser is once again reloaded and ready for operation.

Figure 7:
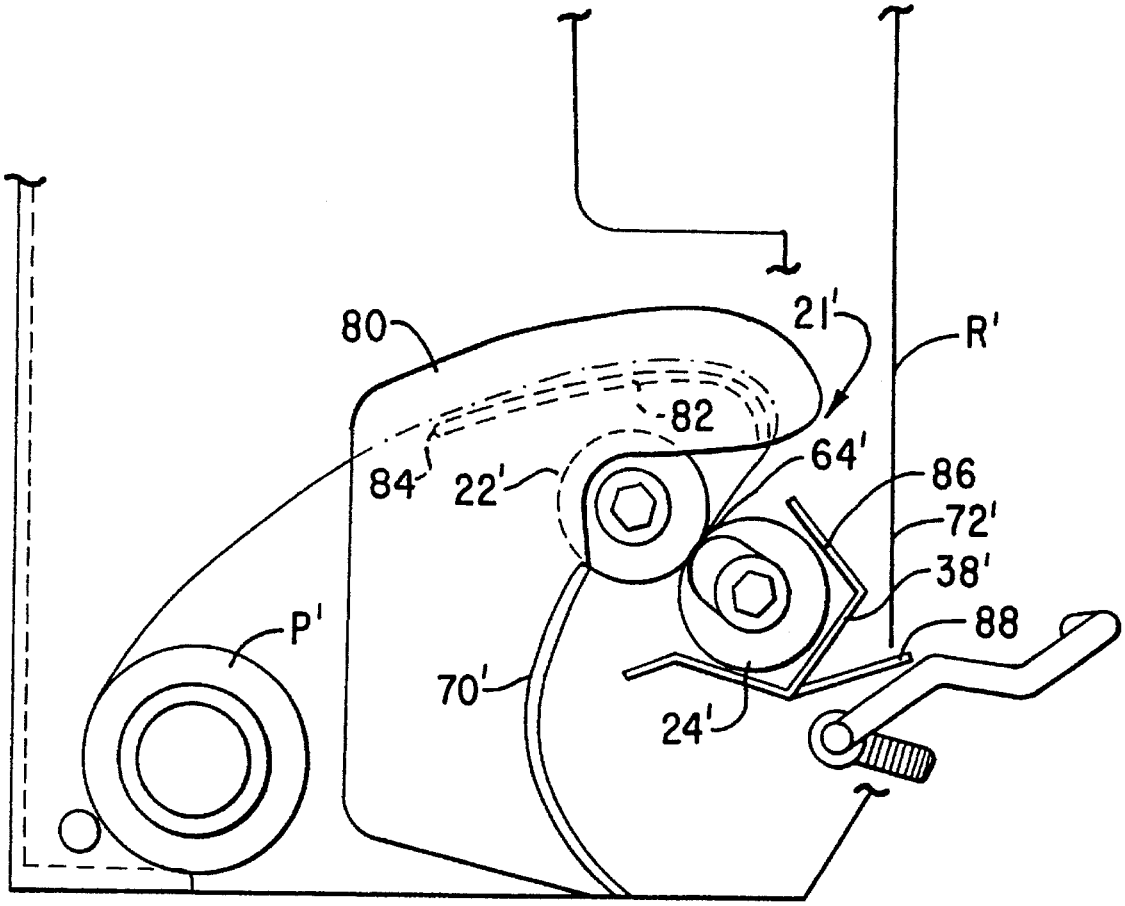
FIG. 7 is a side elevational view of a dispenser according to another embodiment in the present invention, with the cover in an open position.
Figure 8:
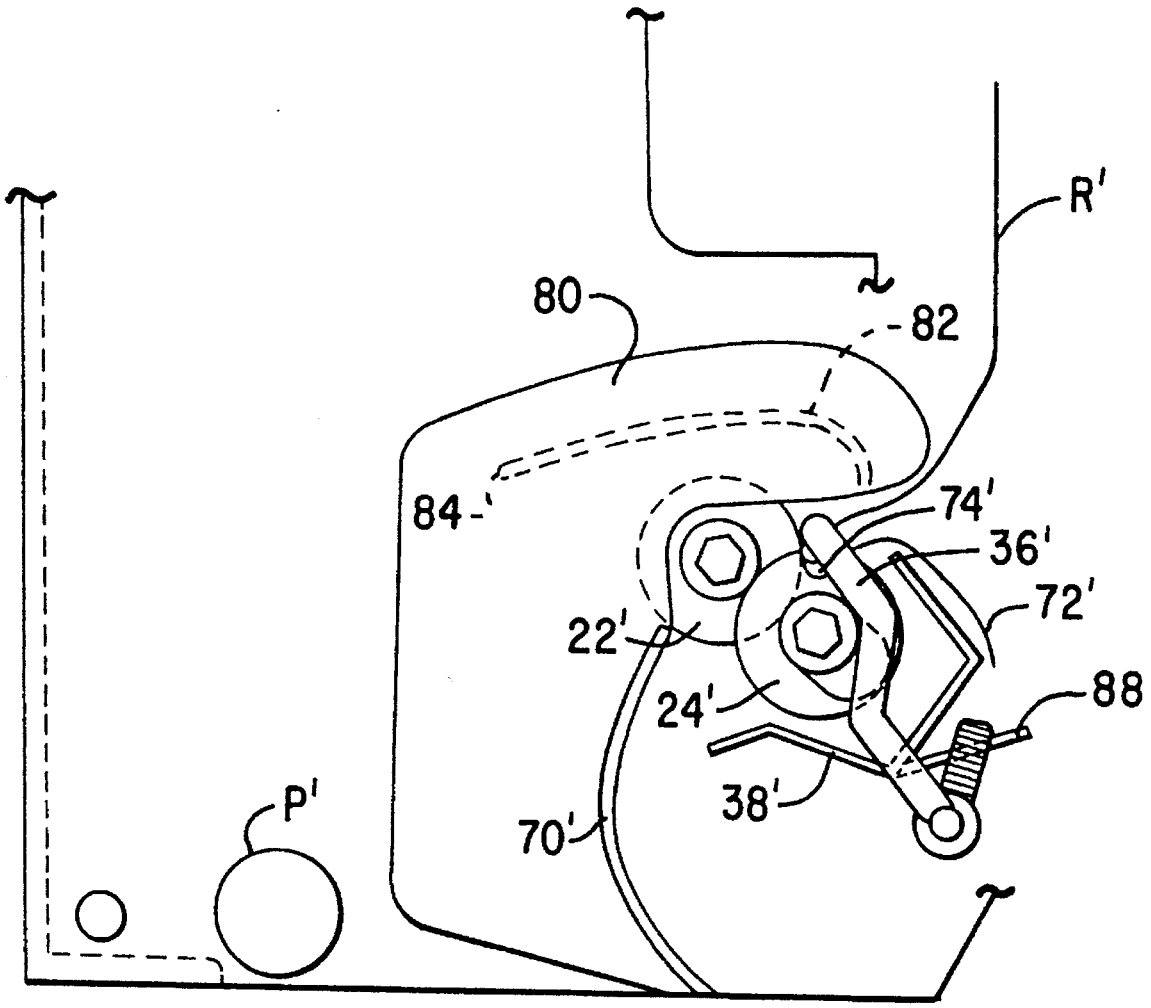
FIG. 8 is a side elevation view of the dispenser shown in FIG. 7 illustrating web material beginning to dispense from the reserve roll.

A second and most preferred embodiment of the feed mechanism of the present invention is shown schematically in FIGS. 7 and 8 and designated generally by the reference numeral 21'. As shown, the orientation of feed roller 22' relative to feed roller 24' is shifted circumferentially by approximately 45 degrees from the position shown in FIGS. 1–6. Deflector 70 terminates adjacent a pair of sidewalls 80 disposed on each end thereof and an upper ramp 82 is connected and extends between sidewalls 80 above the feed rollers to form, in connection with sidewalls 80, a chute for web material from the primary roll. Sidewalls 80 are provided to prevent the web material from drifting from side to side as it, feeds into the feed nip 64'. The web is thus also prevented from getting caught in the gears on the sides of the feed rollers. The formation of the paper chute using ramp 82 ensures that the web material is in tension as it passes thereover and thereby increases the effectiveness of the sidewalls in preventing the web from feeding at a skewed angle. The rear edge of ramp 82 also provides a stripping edge 84 which assists in removing the last sheet of web material from the core of the primary roll P'. If the web material is glued too strongly to the core, the core tends to be pulled upwards with the last sheet of material and jams the feeding mechanism. Accordingly, stripping edge 84 ensures that the last sheet of paper is pulled off from the core. Deflector 70', sidewalls 80 and upper ramp 82 are, preferably, integrally molded of plastic to form a one-piece unit which is disposed within the chassis of the dispenser shown in FIG. 1. Comb-like teeth (not shown) may also extend from top feed roller 22' to upper ramp 82 to provide support for the paper chute and to prevent the web material from going on the wrong side of the ramp 82.

The blade 38' of the second preferred embodiment has a generally U-shaped configuration which extends around the bottom feed roller. The upper leg 86 of blade 38' acts as a guard in that it prevents the web from the reserve roll R' from prematurely being drawn into the feed nip. As shown in the preferred embodiment of FIG. 7, the leading edge 72' of the reserve roll R' is pulled downwards and left hanging in front of leg 86. The orientation of the feed rollers allows the leading edge to be freely dangling, instead of being pierced by a holding tab as in the previous embodiment. If desired, however, such a holding tab may be used. Blocking fingers 88 are also provided to dictate how long of a length of reserve web material should be left hanging down in front when the dispenser is being loaded. If too much reserve web is accidently unwound, the web can then block the exit opening once the cover is closed. Thus, blocking fingers 88 supply a guide for the proper length of reserve web to be unwound.

Referring to FIG. 7, the dispenser is shown in the loading position. The primary roll of material P' is disposed in the rear compartment of the dispenser and the web is fed through the paper chute defined by sidewalls 80 and ramp 82 before feeding into feed nip 64' The web material, in this embodiment, is prevented from going sideways by the paper chute and it therefore enters feed nip 64' generally parallel to the longitudinal axes of the feed rollers. As a result of passing over the paper chute and being held in the correct position, the web material also enters feed nip 64' tangentially, without passing around either of the feed rollers. As shown in FIG. 8, after the trailing end of the primary roll exits the feed nip, the absence of web material allows feed roller 24' to move towards feed roller 22' and the roller thus obtain an intermeshing position which actuates transfer mechanism 36'. Accordingly, transfer mechanism 36' is actuated responsive to the absence of the web material directly at the feed nip, as described above for the first preferred embodiment. Contrary to prior art transfer mechanisms which are dependent on the web extending around the feed rollers or a nearby guide plate to detect the absence of the web material, the operation of the transfer mechanism of the present invention is not adversely affected by the primary web tangentially entering the feed nip and thereby not wrapping around the feed rollers. As similarly described for the first embodiment of the invention shown in FIGS. 1–6, once the reserve web is moved adjacent feed nip 64' by transfer bar 74', the driving rotation of the feed rollers pulls the reserve web into the feed nip 64' and dispensing therefrom then commences. The core of the primary roll P', meanwhile, remains in the bottom of the chassis until the dispenser is once again reloaded.

The present invention thus provides an economical and reliable device for sequentially dispensing web material from a primary roll and a reserve roll. A preferred embodiment of the dispenser utilizes the feed rollers as the sensing mechanism which triggers the transfer mechanism. Since the feed rollers are already needed to dispense web material, sensing is accomplished without the use of additional components and without complicating the usual operation of the dispenser. In addition, since the feed rollers trigger the transfer mechanism only when the web leaves the feed nip, double sheet dispensing does not occur. Therefore, unlike prior art dispensers which sensed adjacent the feed mechanism or around a feed roller, the present invention does not waste the web material. It will be obvious to one of ordinary skill in the art that numerous modifications may be made without departing from the true spirit and scope of the present invention, which is to be limited only by the appended claims.

What is claimed is:

1. A dispenser for flexible sheet material, comprising:

a chassis defining at least in part a primary roll area for a primary web roll and a reserve roll area for a reserve web roll having a reserve web leading edge;

a pair of feed rollers defining a feed nip as the contact area therebetween and positioned such that the web of the primary roll in the primary roll area is feedable therethrough; and biasing means for introducing, upon passage of a trailing edge of the primary web from said feed nip, the reserve web leading edge into said feed nip such that dispensing of said reserve web commences.

2. The dispenser of claim 1 wherein said biasing means comprises a spring.

3. The dispenser of claim 2 wherein said spring includes a coil spring which is biased against a cover of said chassis.

4. The dispenser of claim 1 wherein said chassis includes a back portion and a front cover portion, the reserve web leading edge is introduced into said feed nip from front to back relative to said chassis.

5. The dispenser of claim 1 wherein said pair of feed rollers comprises a pair of grooved, selectively intermeshing feed rollers, said grooved feed rollers being positionable in a generally non-intermeshing relation and in an alternative intermeshing relation, said grooved feed rollers being positioned in an intermeshing relation immediately after the trailing edge of the primary web passes through said feed nip, and said grooved feed rollers being positioned in a generally non-intermeshing relation when the primary web is dispensing through said feed nip.

6. The dispenser of claim 1 further including a blade disposed in said chassis against which the primary web passing through said nip is severed, wherein said chassis includes a back portion and a front cover portion, the reserve web leading edge freely hangs in front of said feed nip relative to said chassis and said blade includes an upper leg for preventing the reserve web leading edge from prematurely entering said feed nip.

7. The dispenser of claim 6 wherein said blade further includes a plurality of blocking fingers for limiting a length of the reserve web freely hanging in front of said feed nip.

* * * * *